US010408587B1

(12) United States Patent
Smith et al.

(10) Patent No.: US 10,408,587 B1
(45) Date of Patent: Sep. 10, 2019

(54) ON-BOARD POWER GENERATION FOR ROLLING MOTOR MISSILES

(75) Inventors: Brian J. Smith, Huntsville, AL (US); Kevin D. Kennedy, Huntsville, AL (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 4458 days.

(21) Appl. No.: 11/379,479

(22) Filed: Apr. 20, 2006

(51) Int. Cl.
*F42B 10/64* (2006.01)
*F42B 10/66* (2006.01)

(52) U.S. Cl.
CPC ..... *F42B 10/668* (2013.01)

(58) Field of Classification Search
USPC ..... 102/348, 207, 208; 244/3.1, 3.21, 3.24, 244/3.29
See application file for complete search history.

(56) References Cited

U.S. PATENT DOCUMENTS

| | | | | |
|---|---|---|---|---|
| 4,898,342 | A * | 2/1990 | Kranz et al. | 244/3.21 |
| 4,964,593 | A * | 10/1990 | Kranz | 244/3.24 |
| 5,452,864 | A * | 9/1995 | Alford et al. | 244/3.23 |
| 6,604,705 | B2 * | 8/2003 | Pellegri et al. | 244/3.24 |
| 6,845,714 | B1 * | 1/2005 | Smith et al. | 102/208 |
| 7,354,017 | B2 * | 4/2008 | Morris et al. | 244/3.23 |
| 7,412,930 | B2 * | 8/2008 | Smith et al. | 102/473 |

* cited by examiner

*Primary Examiner* — Derrick R Morgan
(74) *Attorney, Agent, or Firm* — Michael K. Gray

(57) ABSTRACT

A missile is provided with a motor section that is separated from a guidance and control section by a roller bearing section. A shaft connected to the motor section extends through the roller bearing section and connects to a gear unit that drives a shaft connected to an electrical generator. As the missile moves in flight, vanes on the motor section catch air flow which causes the motor section to rotate. The kinetic energy of the motor section is then converted into electrical energy by the gear unit and electrical generator. A flight computer, a sensor and electro-mechanical actuators are supplied electrical energy from a voltage regulator connected to the electrical generator. The electro-mechanical actuators are connected to corresponding control fins which control the flight path of the missile.

6 Claims, 3 Drawing Sheets

ON-BOARD POWER GENERATION FOR ROLLING MOTOR MISSILES

DEDICATORY CLAUSE

The U.S. Government is the sole assignee/owner of the invention described and claimed herein.

BACKGROUND

The U.S. Army is currently developing technologies and weapon systems for the Future Force. A key component of the future force is the deployment of precision guided weapon systems to replace unguided area weapons to provide one shot kills and to reduce collateral damage. The development of new weapon systems is very expensive and time consuming. The Army development community has been very successful in designing guidance packages that can be retrofitted to existing unguided rockets which results in a cost effective precision weapon in a much shorter time frame than the development of a totally new weapon system.

The power source, typically a thermal battery, is a key component of all missile systems. The battery must be activated in a very active manner under a wide range of environmental conditions. Also, the battery is normally a limiting factor in the shelf life of missile systems. Thus, a need has been recognized for a self-generating power system contained within a missile that is not subject to the uncertainties of waning battery life.

In U.S. Pat. No. 6,845,714, which issued to Smith et al. on Jun. 25, 2005 and which is hereby incorporated by reference, a guided projectile is provided with air inlets used to direct an air stream to drive a turbine that in turn drives an electrical generator for powering the projectile's guidance system.

In certain classes of missiles, a motor section of the missile spins during flight for purposes of stabilization. The present invention proposes to utilize the kinetic energy created by the rotation of such missiles' motor sections for conversion into electrical power generation. Further, the teachings of the present invention can be utilized to retrofit previously existing missiles without need of manufacturing an entire new missile design.

SUMMARY OF THE INVENTION

Accordingly, one object of the present invention is to provide internalized power generation of a missile by converting the kinetic energy created by the rotation of the missile's motor section to electrical power generation.

Yet another object of the present invention is to provide an on-board power generation system for a missile without degrading the aerodynamics of the missile.

Still another object of the present invention is to provide an on-board power generation system that can be easily retrofitted with an existing missile design.

These and other valuable objects and advantages are realized by a power generating or self charging aerodynamic device or missile having a rotatable motor section that is provided with a plurality of wrap-around vanes that are positioned around the rotatable motor section's cylindrical periphery.

The invention further includes a guidance and control section which houses a plurality of guidance and control elements within the cylindrical and nose portions of the guidance and control section. The guidance and control elements include a flight computer, a sensor and electro-mechanical actuators.

A roller bearing section is positioned between the rotatable motor section and the guidance and control section. A shaft connected to the rotatable motor section of the missile extends through the roller bearing section and connects to a gear unit. The gear unit is connected to a second shaft that connects to an electrical generator.

When the missile is in flight, the rotatable motor section rotates so as to produce kinetic energy that is translated into electrical energy by the gear unit and electrical generator. The electrical charge produced by the electrical generator is stored in a charge storing unit that is connected to a voltage regulator. When electrical energy is required to activate the electro-mechanical actuators, signals from the flight computer result in required electrical energy being supplied from the energy storage unit to the electro-mechanical actuators. The electro-mechanical actuators allow controlled movement of corresponding control fins which are used to steer the missile on a desired flight path.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION

Figure 1:
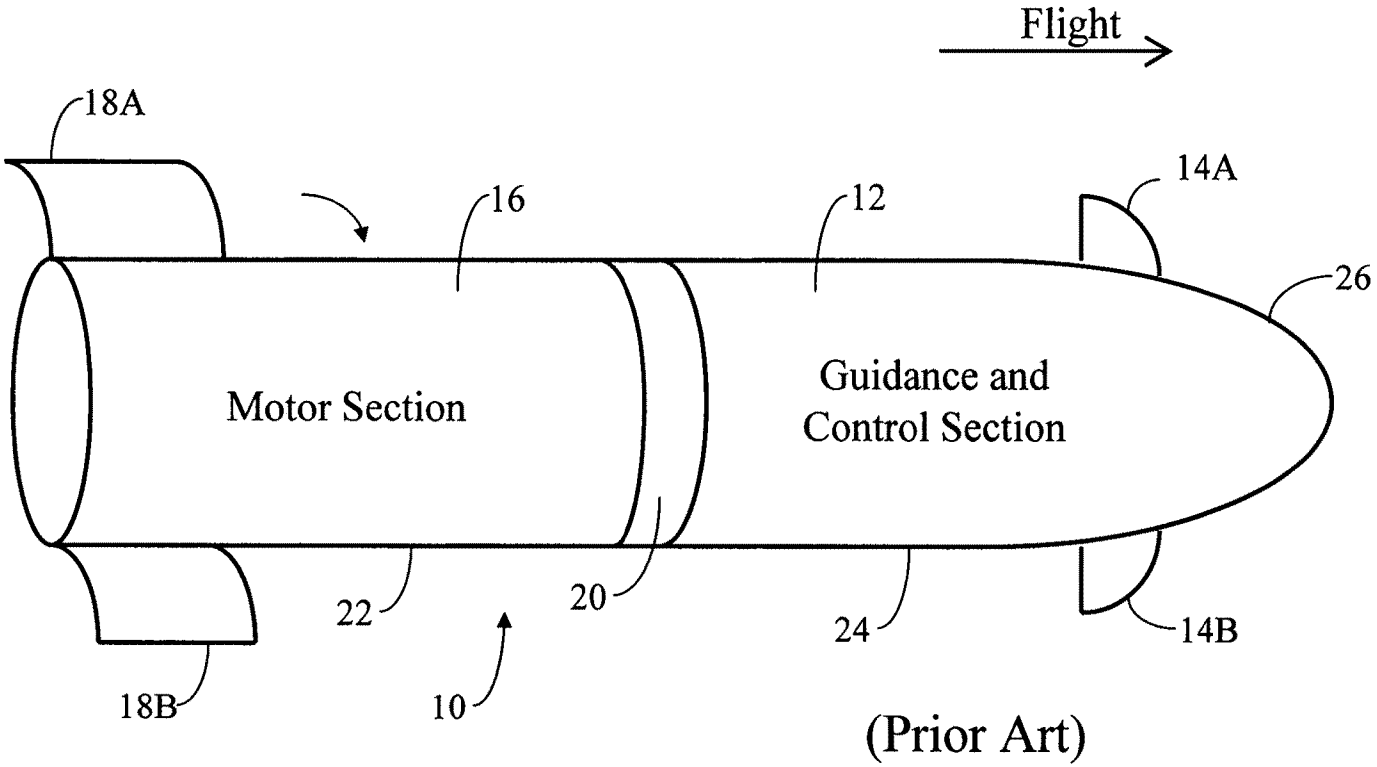
(Prior Art) Figure 1
FIG. 1 is a side-view of a conventional missile having a rotating motor section used for flight stabilization.

With reference to FIG. 1, a prior art missile 10 is provided with a guidance and control section 12 that is positioned at the front of the missile. The guidance and control section 12 has a cylindrical body portion 24 which connects to the nose 26. Fins 14A, 14B located at opposite sides and behind the nose of the missile function as flight control surfaces.

A motor section 16 is rotatable and has spin actuating fins 18A, 18B located at the peripheral end of the missile. The motor section has a cylindrical body 22. The motor section 16 and the guidance and control section 12 are separated from each other by a roller bearing section 20 that allows the motor section to spin while maintaining the guidance and control section 12 in a f ixed, non-spinning posture. The rotating motor section 16 provides aerodynamic stability to the missile 10.

Missile 10 utilizes a conventional battery (not shown) to power the components of the guidance and control section. As has been mentioned, conventional batteries limit the shelf life of such missiles and diminish reliability.

Figure 2:
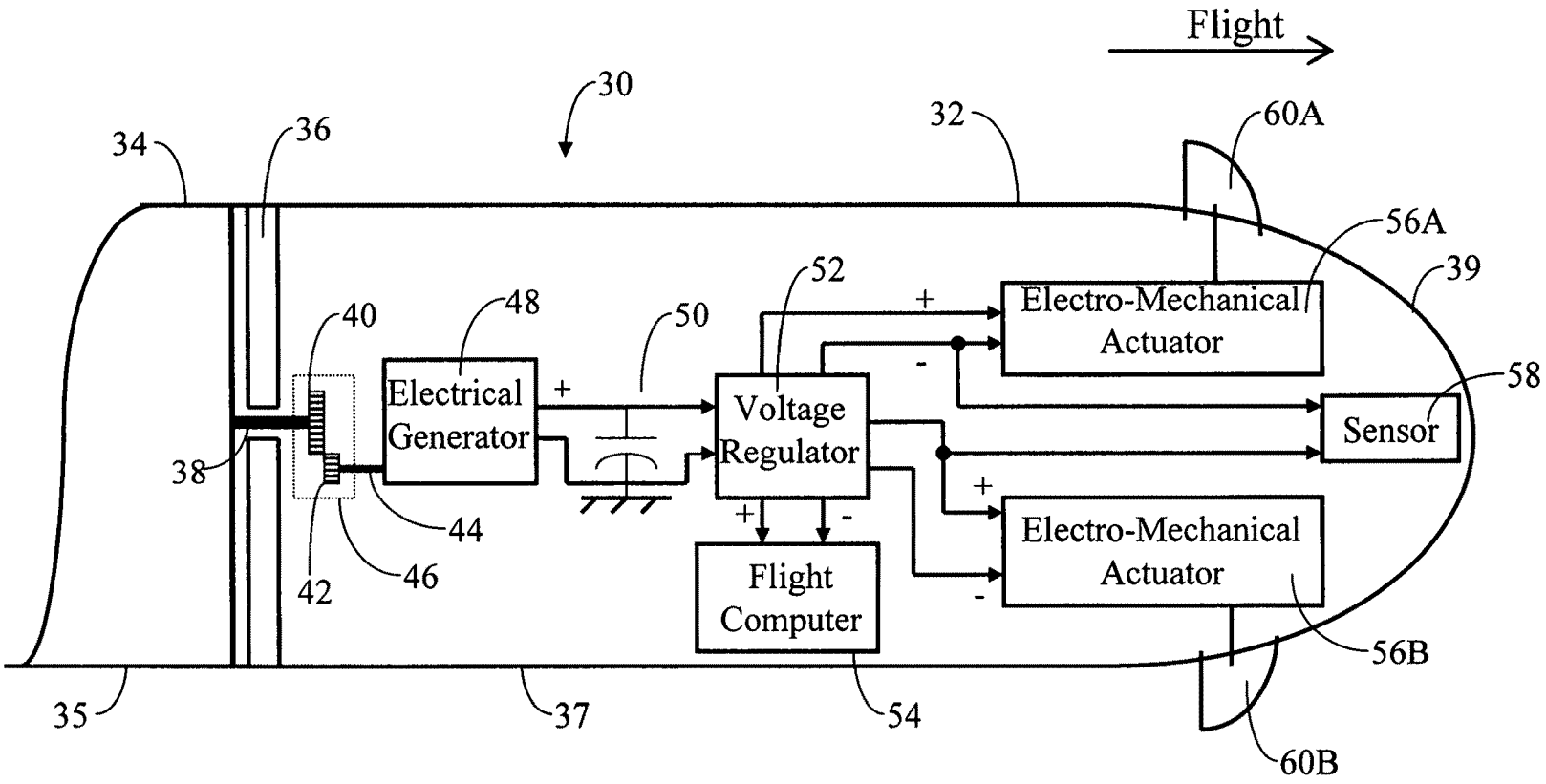
FIG. 2 is a side-view schematic illustration of a missile having the on-board power generating system according to the present invention.

In FIG. 2, a missile 30 according to the present invention is provided with a guidance and control section 32 that is housed in the front section of missile 30. The guidance and control section 30 has a cylindrical body portion 37 and a nose 39. Missile 30 is further provided with a rotatable motor section 34 that represents the rear or aft section of the missile. The rotatable motor section has a cylindrical body 35 with the motor components (not shown) being located radially within the cylindrical body. A roller bearing section 36 is located between the motor section 34 and the guidance and control section 32. A shaft 38 is rigidly connected to the motor section 34 and extends through the roller bearing section and into the control section of the missile.

The end of the shaft 38 that is located in the control section of the missile is connected to a gear 40. A second gear 42 in the guidance and control section 32 connects to a rotatable shaft 44. Gear 40 and gear 42 form a gear unit 46. The rotatable shaft 44 is connected to an electrical generator 48. The rotation of the motor section 34 causes gear 40 to rotate about gear 42 thus causing shaft 44 to rotate which results in electricity being generated in the electrical generator 48.

The electrical generator 48 is connected to an energy storage device or capacitor 50 which acts as a low pass filter for smoothing the output of the generator. Further, the capacitor 50 stores energy that can be used during high-energy demand situations. A voltage regulator 52 is connected to capacitor 50. Voltage regulator 52 is connected to a flight computer 54, to electro-mechanical actuators 56A and 56B, and to sensor 58.

Electromechanical actuator 56A is utilized to move control fin 60A and electromechanical actuator 56B is utilized to move control fin 60B so as to control the flight path of the missile. The sensor 58 feeds sensory data back to the flight computer 54 which can then generate signals, if needed, to utilize the stored charge in the capacitor 50 for activation of the electro-mechanical actuators 56A, 56B to move control fins 60A, 60B into desired flight positions.

Figure 3:
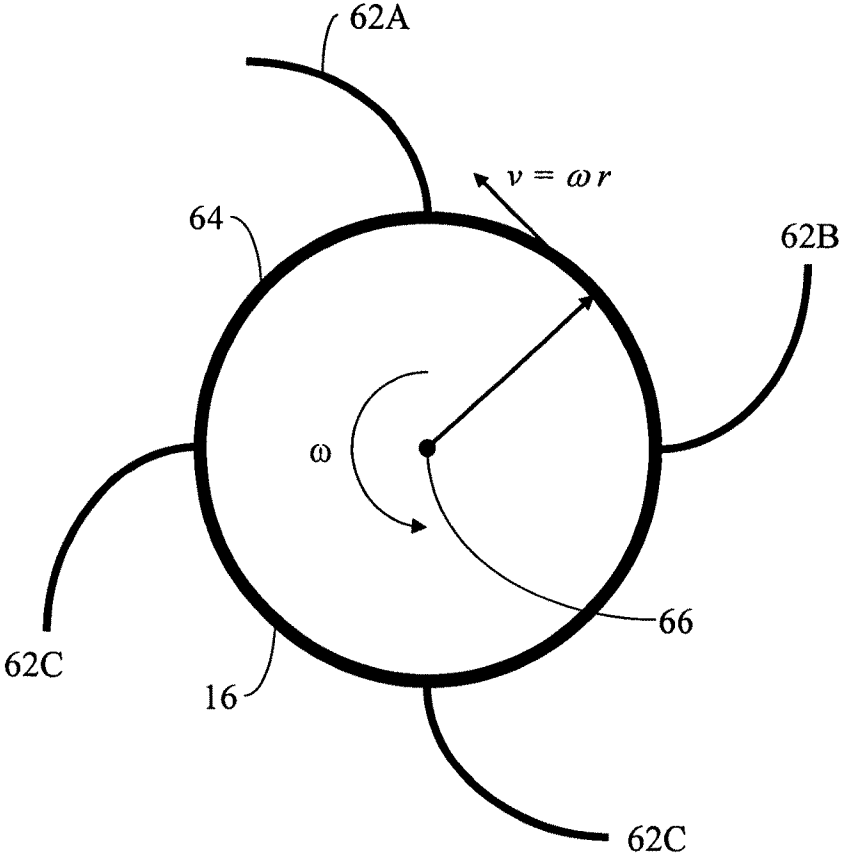
FIG. 3 demonstrates the axis of rotation of the rotatatable motor section of a missile according to the present invention whose dimensions are utilized in determining the amount of kinetic energy which will be available for conversion to electrical energy.

FIG. 3 is a cross-sectional illustration of the motor section 16 viewed from a frontal orientation of the missile 30. The motor section is bounded by a skin or motor casing 64 that covers the cylindrical body 35 (FIG. 2). A radius r extends from the axis of rotation 66 to a point on the casing 64.

Wrap around vanes 62A, 62B, 62C and 62D are located at 90° intervals around the periphery of the cylindrical body or motor casing 64. During free flight of the missile 30, the vanes 62A, 62B, 62C and 62D will induce a roll rate that causes the motor section 16 to rotate with an angular velocity ω.

The kinetic energy of the rotating motor section is given by

Kinetic Energy= $\frac{1}{2} mv^2$

In the equation above, m is the mass of the rotating motor section and v is the velocity of a point on the motor case or skin 64 surrounding the motor section 16. The velocity is calculated by the expression $v=\omega r$. The velocity is therefore determined by multiplying the angular velocity by radius r. This kinetic energy of the rotating motor section is converted to electrical energy by electrical generator 48 insuring there will always be enough electrical power available to guide, power and direct the missile.

The present invention generates sufficient electrical charge during the flight of a missile to power the electrical load requirements of the missile's flight control and guidance components. Further, in that the self-charging system of the present invention can be retrofitted into existing missile designs, the present invention provides realiability with affordability.

Modifications of the above teachings are possible without deviating from the spirit of the present invention. Accordingly, the scope of the present invention is only limited by the claims which follow.

What is claimed is:

1. An electrically self-charging missile (30), comprising:
- a rotatable motor section (34);
- vanes (62A, 62B, 62C) connected to and arranged on said rotatable motor section so as to cause rotation of said rotatable motor section when the electrically self-charging missile (30) is in flight;
- a roller bearing section (36);
- a guidance control section (32);
- a shaft (38) connected to said rotatable motor section and extending through said roller bearing section (36);
- a gear unit (46) connected to said shaft (38);
- an electrical generator (48) connected to said gear unit;
- a capacitor (50) connected to said electrical generator (48);
- a first electromechanical actuator (56A) and a second electromechanical actuator (56B);
- a voltage regulator (52) connecting to said capacitor (50);
- a first control fin (60A) and a second control fin (60B), said first electromechanical actuator (56A) actuating said first control fin (60A) and said second electromechanical actuator (56B) actuating said second control fin (60B); and
- wherein said roller bearing section (36) is located between said rotatable motor section (34) and said guidance control section (32); and
- wherein said voltage regulator (52), said gear unit (46), said electrical generator (48), said capacitor (50), and said first and second electromechanical actuators (56A, 56B) are located within said guidance control section (32).

2. An electrically self-charging missile (30), according to claim 1, wherein:
- said gear unit (46) has a first gear (40) which connects directly to said shaft (38), said first gear (40) contacting a second gear (42), said second gear being connected to a second shaft (44) connected to said electrical generator (48).

3. An electrically self-charging missile (30), according to claim 2, further comprising:
- a flight computer (54) connected to said voltage regulator (52).

4. An electrically self-charging missile (30), according to claim 3, further comprising:
- a sensor (58) connected to said voltage regulator (52).

5. An electrically self-charging missile (30), according to claim 4, wherein:
- said sensor (58) is located within said guidance control section (32).

6. An electrically self-charging missile (30), according to claim 5, wherein:
- said flight computer (54) is located within said guidance control section (32).

* * * * *